United States Patent [19]

Ooura

[11] 4,365,403

[45] Dec. 28, 1982

[54] METHOD OF AND APPARATUS FOR INTERENGAGING A PAIR OF SLIDE FASTENER STRINGERS

[75] Inventor: Yasumasa Ooura, Kurobe, Japan

[73] Assignee: Yoshida Kogyo K.K., Japan

[21] Appl. No.: 211,805

[22] Filed: Dec. 1, 1980

[30] Foreign Application Priority Data

Dec. 18, 1979 [JP] Japan ..... 54-164260

[51] Int. Cl.[3] ..... B23P 19/04

[52] U.S. Cl. ..... 29/408; 29/766

[58] Field of Search ..... 29/33.2, 408, 410, 429, 29/766

[56] References Cited

U.S. PATENT DOCUMENTS

| | | | |
|---|---|---|---|
| 2,219,165 | 10/1940 | Nedal | 29/408 |
| 2,287,263 | 6/1942 | Nedal | 29/408 |
| 2,613,433 | 10/1952 | Rojahn | 29/408 |
| 3,270,408 | 9/1966 | Nealis | 29/408 |
| 3,947,946 | 4/1976 | Omori et al. | 29/408 |
| 3,955,263 | 5/1976 | Gauthier | 29/766 X |
| 4,237,604 | 12/1980 | Sawada et al. | 29/766 |
| 4,238,880 | 12/1980 | Takahashi | 29/766 |

FOREIGN PATENT DOCUMENTS

| | | | |
|---|---|---|---|
| 442328 | 2/1936 | United Kingdom | 29/408 |

*Primary Examiner*—Ervin M. Combs

*Attorney, Agent, or Firm*—Robert E. Burns; Emmanuel J. Lobato; Bruce L. Adams

[57] ABSTRACT

A pair of slide fastener stringers are intermittently fed in a pair of longitudinal paths, respectively, in parallel planes with respective rows of coupling elements being directed in one direction. The slide fastener stringers are laterally shifted toward each other off their paths by coupler members as the latter are combined together. A presser is moved into coaction with the combined coupler members to define a generally Y-shaped coupling channel in which the rows of coupling elements are forced into confronting relation. The rows of coupling elements can be interengaged when they move through the coupling channel.

10 Claims, 16 Drawing Figures

FIG. 4
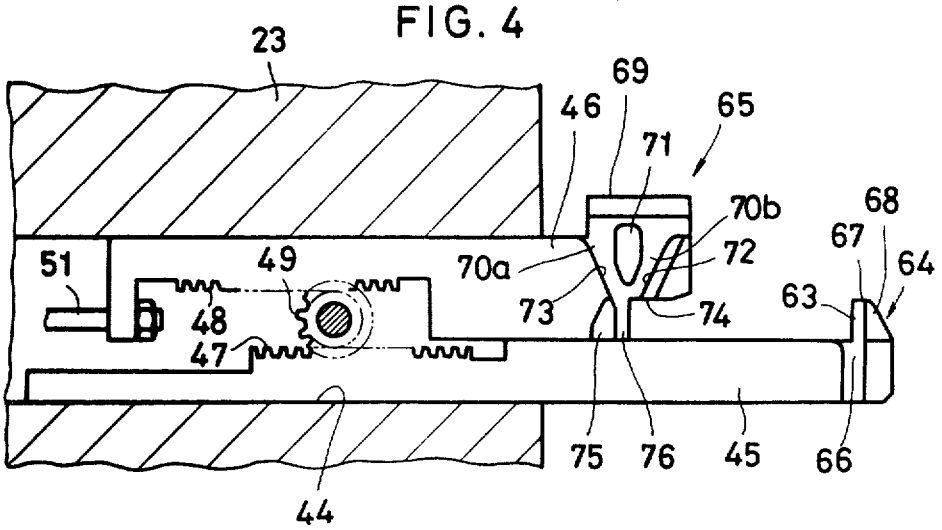
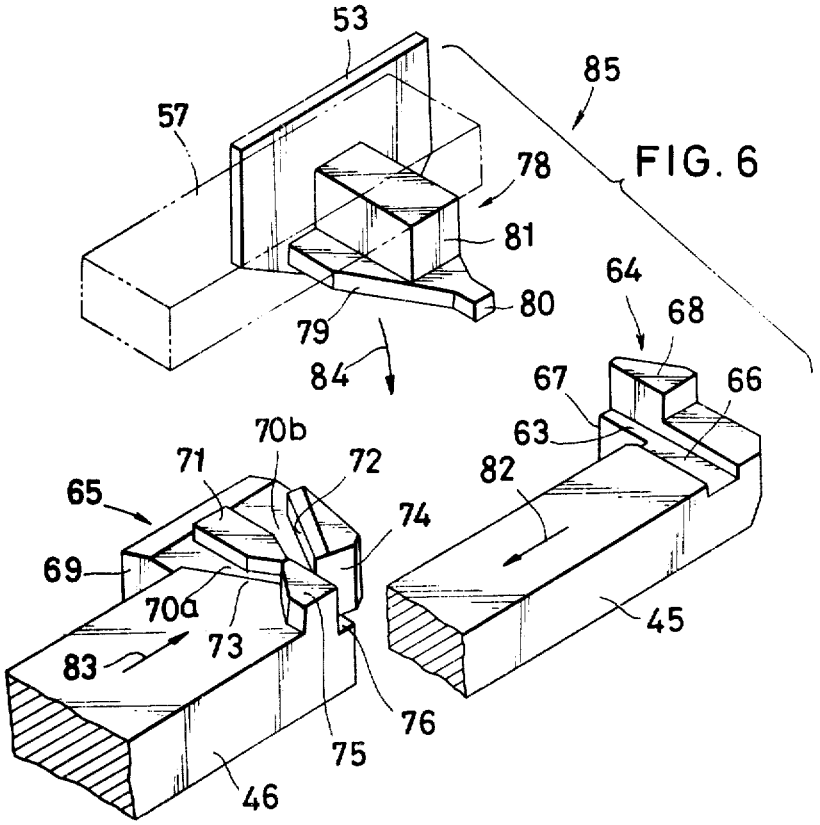
FIG. 6

METHOD OF AND APPARATUS FOR INTERENGAGING A PAIR OF SLIDE FASTENER STRINGERS

BACKGROUND OF THE INVENTION

Field of the Invention

The present invention relates to a method of and an apparatus for interengaging a pair of slide fastener stringers equipped with top stops, sliders, separable bottom stops before the stringers are cut to individual slide fastener lengths.

SUMMARY OF THE INVENTION

A pair of slide fastener stringers including a pair of respective rows of coupling elements are intermittently fed respectively in a pair of longitudinal paths in parallel planes with the rows of coupling elements being directed in one direction, whereupon the stringers as held at rest are displaced laterally toward each other off their paths by a pair of coupler members while the latter are moving into mating engagement with each other. Upon the coupler members are put together, a presser is brought into coaction with the coupler members to define a generally Y-shaped coupling channel and at the same time to cause the rows of coupling elements to be turned into confronting relation to each other in the coupling channel. The slide fastener stringers are then advanced for a short interval to cause the rows of coupling elements to be interengaged over a corresponding interval that is long enough to allow the slide fastener stringers to stick together after their severance to individual slide fastener lengths. Therefore, the rows of coupling elements which were interengaged at the time of dying or heat-setting are mated together again and remain intermeshed after they are cut off, thereby avoiding any risk of the severed slide fastener stringers being left separated and picked up for mismated engagement which would give rise to sluggish slider movement and hence malfunctioning of the finished slide fastener.

It is an object of the present invention to provide a method of intermeshing over short intervals a pair of slide fastener stringers equipped with top stops, sliders, separable bottom stops before the slide fastener stringers are severed into individual slide fasteners.

Another object of the present invention is to provide an apparatus for carrying out such a method.

Still another object of the present invention is to provide a method of and an apparatus for interengaging a pair of rows of coupling elements of a pair of respective slide fastener stringers so that finished slide fasteners can function properly without suffering from sluggish slider movement or mismating of the rows of coupling elements.

The above and other objects, features and advantages of the present invention will become apparent from the following description when taken in conjunction with the accompanying drawings which show preferred embodiments by way of example.

BRIEF DESCRIPTION OF THE DRAWINGS

FIG. 4 is an enlarged fragmentary plan view, partly in cross section, of a pair of joint bars supported in a holder;

FIG. 6 is an enlarged fragmentary perspective view of a coupler before its parts are mated together;

DETAILED DESCRIPTION

Figure 1:
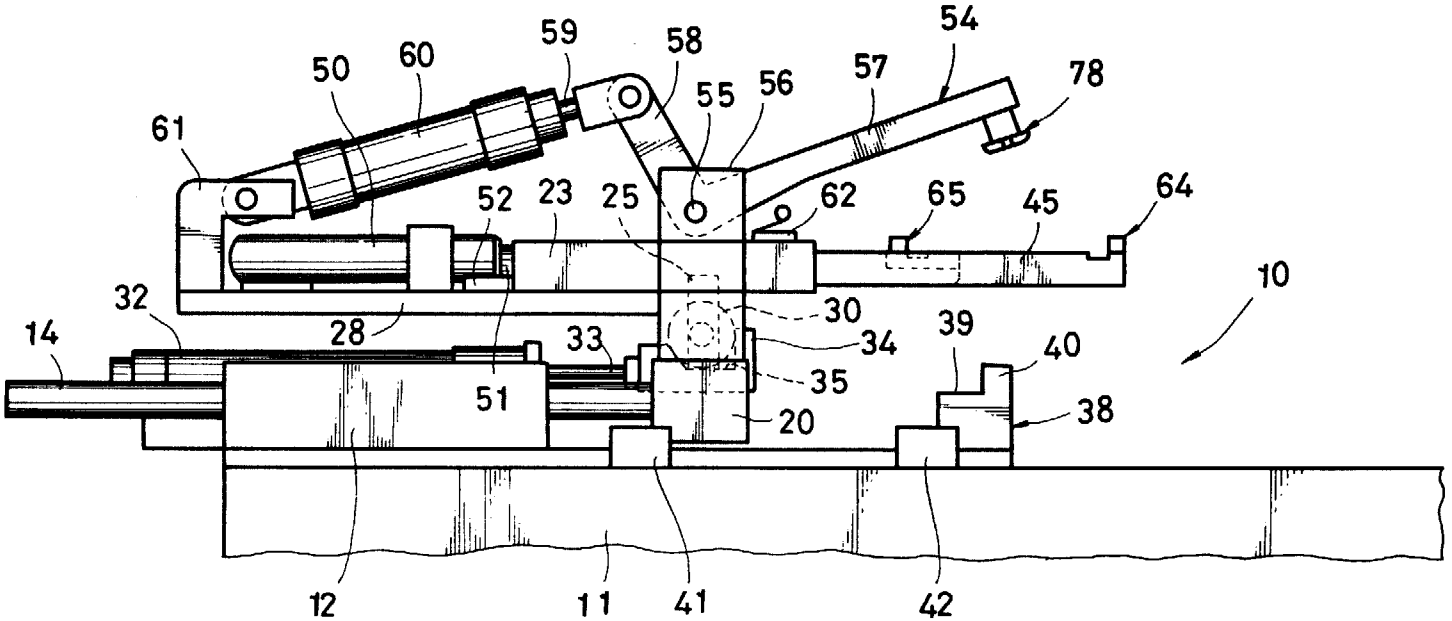
FIG. 1 is a front elevational view of an apparatus for interengaging a pair of rows of coupling elements, the apparatus being readied for operation.
Figure 2:
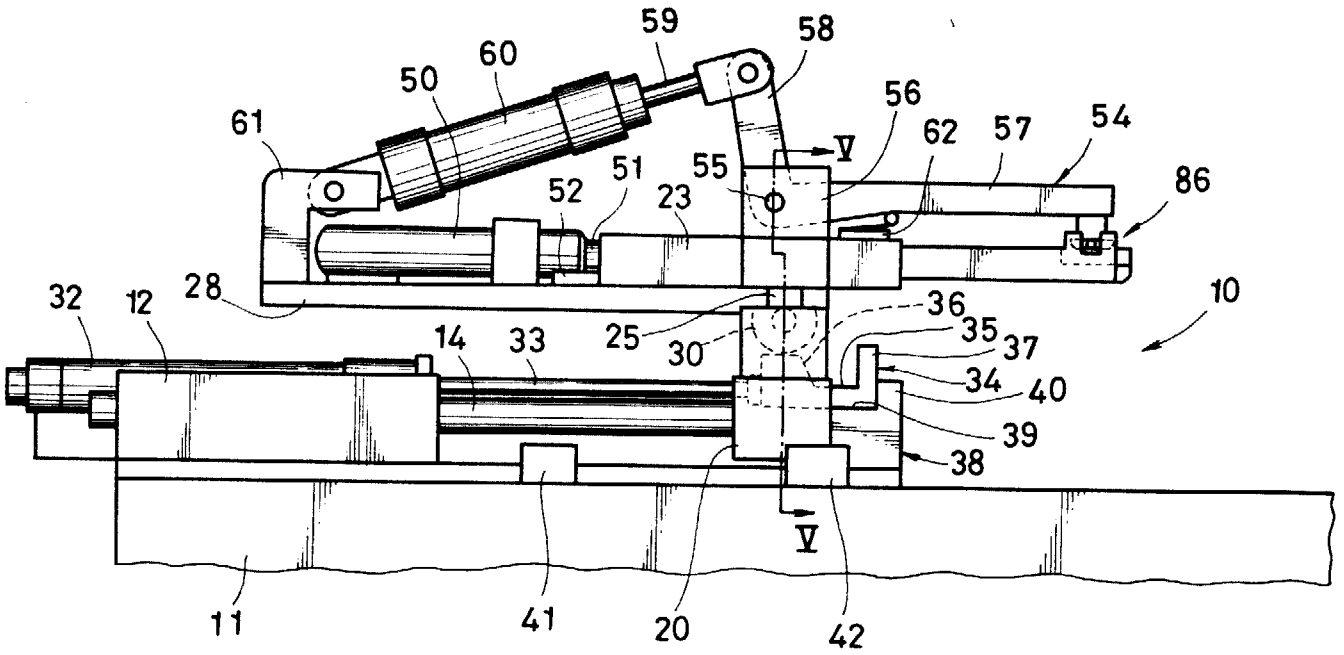
FIG. 2 is a view similar to FIG. 1, showing the apparatus as operated.
Figure 3:
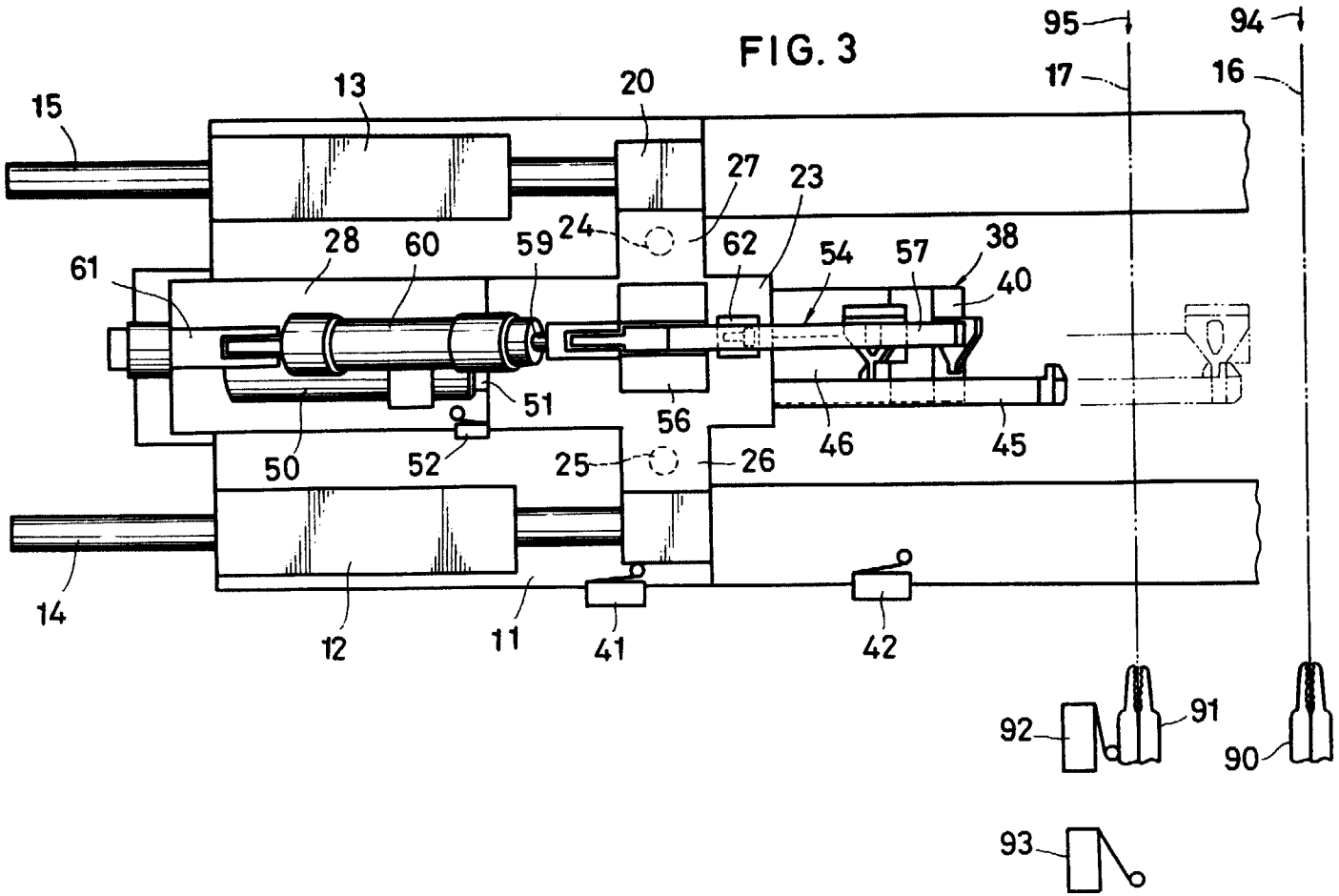
FIG. 3 is a plan view of the apparatus of FIG. 1.
Figure 7:
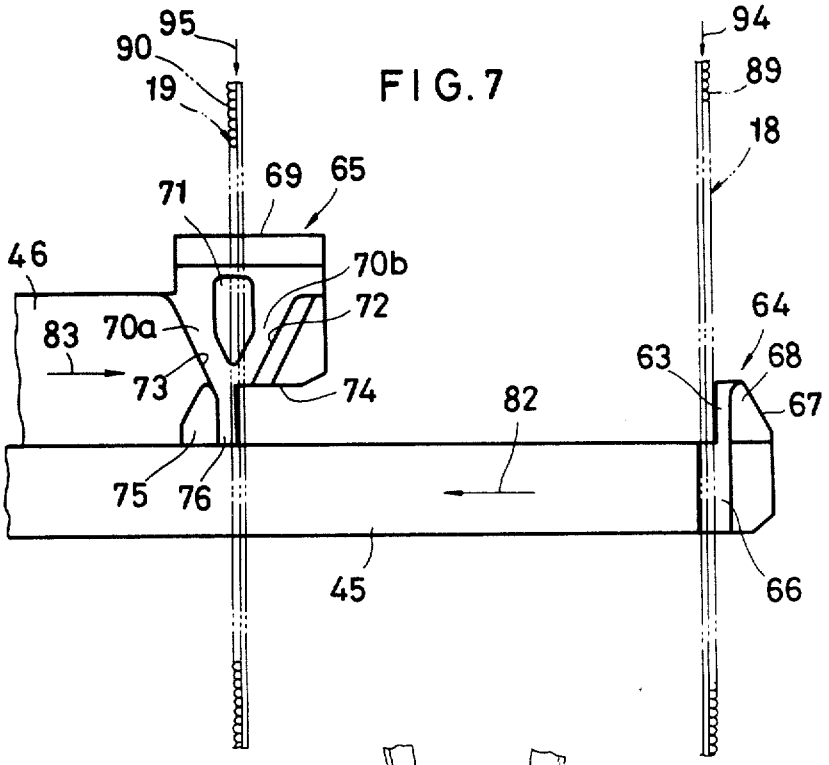
FIG. 7 is an enlarged fragmentary plan view of the joint bars in a position before they pull a pair of slide fastener stringers toward each other.
Figure 16:
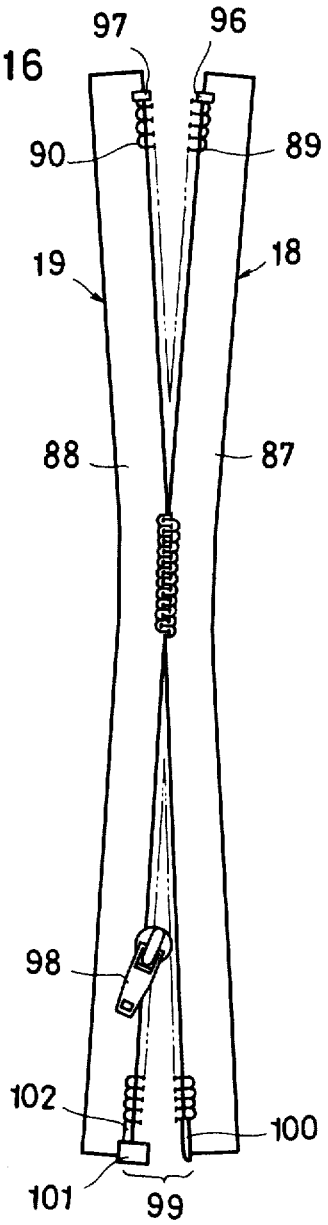
FIG. 16 is a plan view of a finished slide fastener having partly interengaged rows of coupling elements.

As shown in FIGS. 1 through 3, an apparatus 10 for interengaging a pair of slide fastener stringers includes a base table 11 and a pair of laterally spaced bearing blocks 12,13 mounted on the base table 11. A pair of slide rods 14,15 are mounted in the blocks 12,13, respectively, for longitudinal sliding movement in a direction normal to a pair of parallel spaced paths 16,17 (FIG. 3) respectively for a pair of continuous slide fastener stringers 18,19 (FIGS. 7 and 16). The slide rods 14,15 jointly support on one end thereof a transverse end block 20 having a pair of vertical guide holes 21,22 (FIG. 5) spaced laterally from each other.

Figure 5:
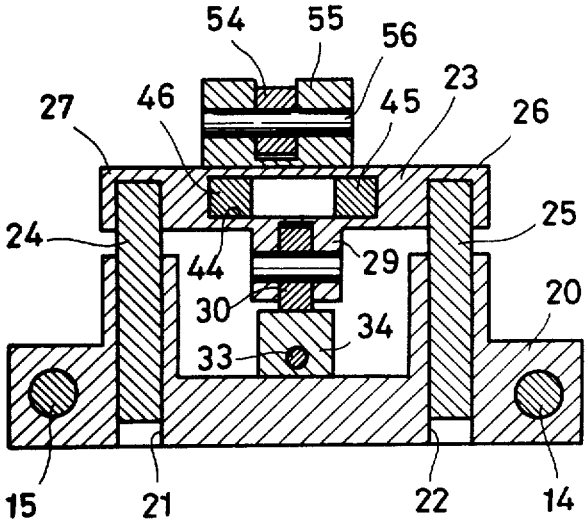
FIG. 5 is a cross-sectional view taken along line V—V of FIG. 2.

A horizontal holder 23 is supported on the end block 20 by a pair of guide bars 24,25 extending downwardly from a pair of lateral wings 26,27 of the holder 23 slidably into the guide holes 21,22, respectively. Thus, the horizontal holder 23 is vertically movable with respect to the end block 20. The horizontal holder 23 includes a support table 28 having a pair of channel projections 29,29 extending downwardly as shown in FIG. 5 and including a roller 30 rotatably supported therebetween.

A first fluid-pressure actuator 32 is mounted on the base table 11 and has a piston rod 33 to which is connected a cam block 34 having a recess 35 defined by an inclined cam surface 36 and a vertical wall 37 as best illustrated in FIG. 2, the recess 35 being respective of the roller 30. A stationary block or stop 38 is also mounted on the base table 11 at a position remote from the bearing blocks 12,13 in alignment with the piston rod 33 and hence the cam block 34. The stationary block 38 has a recess 39 defined by a vertical wall 40 for receiving a portion of the cam block 34. A pair of first and second limit switches 41,42 are mounted on the base table 11 at spaced locations alongside of the path of movement of the slide rod 14, the limit switches 41,42 being actuatable by the end block 20 as it moves. When the first fluid-pressure actuator 32 is actuated, the piston rod 33 is extended until the cam block 34 is received in the recess 39 in abutment against the wall 40. During this time the holder 23 and hence the end block 20 are moved together since the roller 30 is received in the recess 35 in the cam block 34. Shortly before the cam block 34 is held against the wall 40, the end block 20 engages the block 38 and is stopped thereby. Continued advance of the cam block 34 into the recess 39 in the block 38 causes the roller 30 to roll up the cam surface 36, raising the holder 23 as shown in FIG. 2. The second limit switch 42 is energized by engagement with the end block 20 and actuates a timer switch (not shown) which will de-activate the fluid-pressure actuator 32 upon elapse of a predetermined interval of time which is selected to expire when the cam block 34 hits the wall 40. Retraction of the cam block 34 away from the block 38 is stopped when the end block 20 engages the limit switch 41, which then de-energizes the actuator 32.

The holder 23 has therein a slot 44 in which is slidably received a pair joint bars 45,46 (FIG. 4) extending in a direction transverse of the paths 16,17 for the slide fastener stringers 18,19. As shown in FIG. 4, the joint bars 45,46 have a pair of opposite racks 47,48 held in mesh with a pinion 49 disposed therebetween in the slot 44.

A second fluid-pressure actuator 50 is mounted on the support table 28 and has a piston rod 51 fastened to one of the joint bars 46. A third limit switch 52 (FIGS. 1 and 2) is mounted on the support table 28 at a position in the path of movement of the joint bar 45. When the second actuator 50 is actuated to extend the piston rod 51, the joint bar 46 moves with the piston rod 51, and the joint bar 45 moves in the opposite direction until it hits the limit switch 52, whereupon it controls the second actuator 50 so as to be inoperative.

An L-shaped lever 54 is pivotally supported by a pin 55 on the mount 56 disposed on the holder 23. The lever 54 comprises a pair of arms 57,58, the arm 58 being pivotally connected to a piston 59 of a third fluid-pressure actuator 60 pivotally supported on a bracket 61 mounted on the support table 28. A fourth limit switch 62 is mounted on the holder 23 below the lever arm 57. Upon actuation of the third actuator 60 to extend the piston rod 59, the arm 57 of the lever 54 is lowered until it energizes the limit switch 62, which then de-activates the actuator 60.

As shown in FIG. 6, the joint bars 45,46 have a pair of first and second complemental coupler members 64,65, respectively. The first coupler member 64 includes a groove 66 extending transversely of the joint bar 45, a notch 63 continuous to the groove 66 and defined in a nose 67 projecting laterally of the joint bar 45, and a projection 68 adjacent the notch 63 on the nose 67. The second coupler member 65 includes a block 69 on which is defined a pair of convergent grooves **70*a*,70*b* by a central land 71 and a pair of opposite sidewalls 72,73, the convergent grooves 70*a*,70*b* jointly having a V shape. There are defined a recess 74 receptive of the nose 67 of the first coupler member 64, and a notch 76 which is combinable with the notch 63 to provide a groove 77 (FIG. 11) contiguous to the groove 66. The second coupler member 65 also includes a projection 75 adjacent to the notch 76**.

A presser 78 is supported on the lever arm 57 and comprises a substantially triangular plate 79 facing downwardly and including a nose 80. The presser plate 79 is attached to the arm 57 through a block 81. The first and second coupler members 64,65 and the presser 78 are combinable together into a coupler 85 when the joint bars 45,46 and the lever arm 57 are moved in the directions of the arrows 82,83,84, respectively, the coupler 85 defining therein a generally Y-shaped coupling channel 86 (FIGS. 8 and 9) composed jointly of the convergent grooves **70*a*,70*b*, the groove 77, and the groove 66. A spreader plate 53 is secured to the arm 57 behind the presser plate 79 for spreading the stringers 18,19 against the risk of the latter's getting jammed in the grooves 70*a*,70*b***.

The slide fastener stringers 18,19 are intermittently fed in the paths 16,17 in parallel planes by a pair of grippers 90,91 (FIG. 3) which can be detected by a pair of fifth and sixth limit switches 92,93 to start sequential control of the first, second and third fluid-pressure actuators 32,50,60 as described later on.

As illustrated in FIG. 16, the slide fastener stringers 18,19 shown cut to a slide fastener length include a pair of stringer tapes 87,88 on which a pair of row coupling elements 89,90 are mounted, respectively. The stringers 18,19 also include a pair of top stops 96,97 attached at one end of the rows of coupling elements 89,90, a slide 98 slidably mounted on the row of coupling elements 90, and a separable bottom stop 99 comprising a pin 100 mounted on the tape 87 at the other end of the row of coupling elements 89, and a box 101 and a box pin 102 mounted on the tape 88 at the other end of the row of coupling elements 90.

Figure 8:
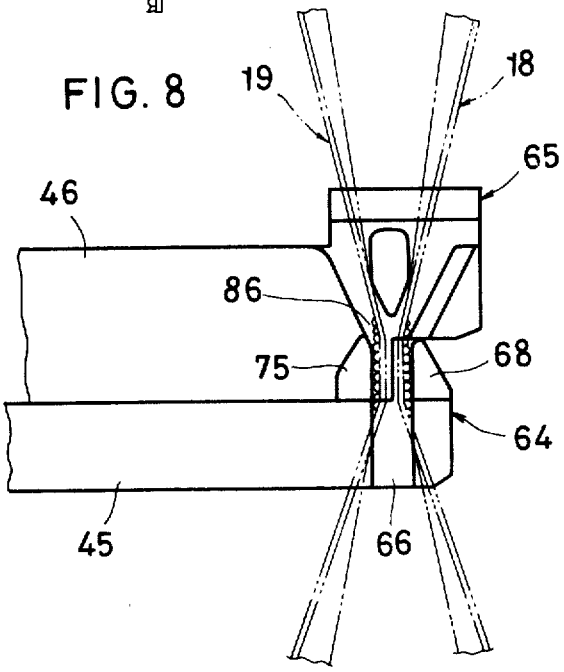
FIG. 8 is an enlarged fragmentary plan view of the joint bars as they have displaced the stringers together.
Figure 9:
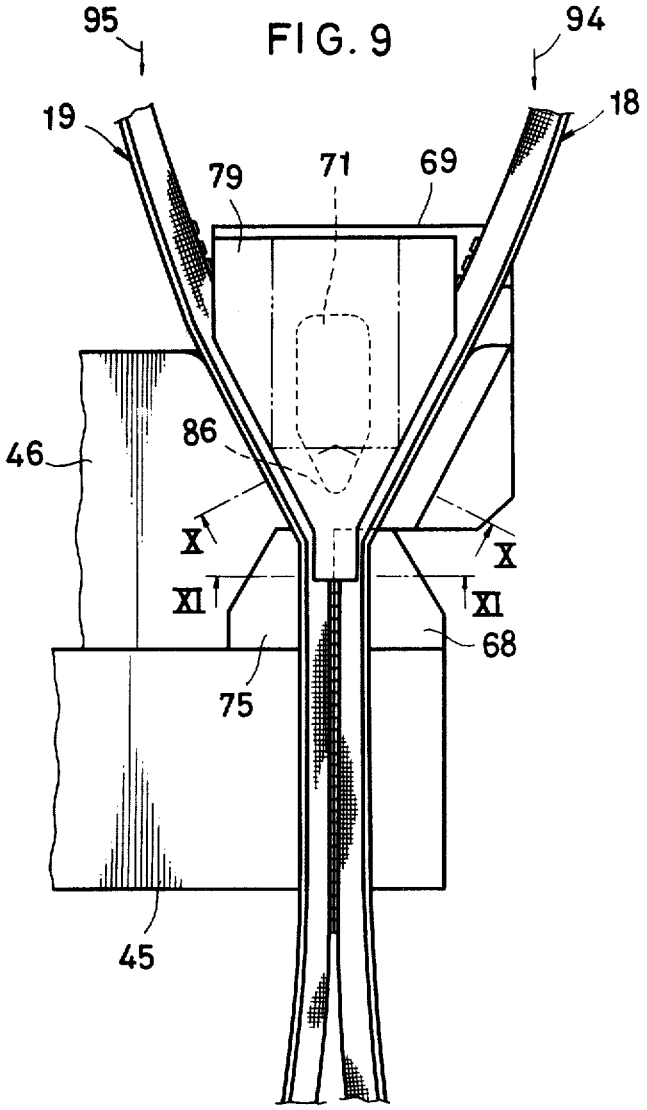
FIG. 9 is an enlarged plan view of the mated coupler.
Figure 10:
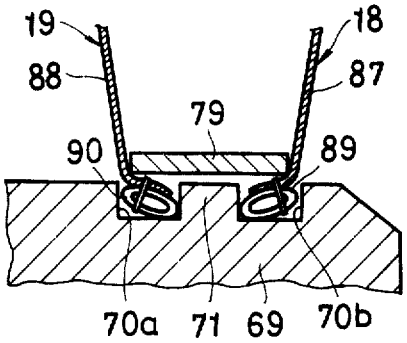
FIG. 10 is an enlarged cross-sectional view taken along line X—X of FIG. 9.
Figure 11:
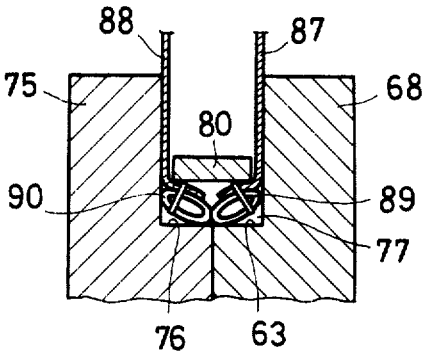
FIG. 11 is an enlarged cross-sectional view taken along line XI—XI of FIG. 9.
Figure 12:
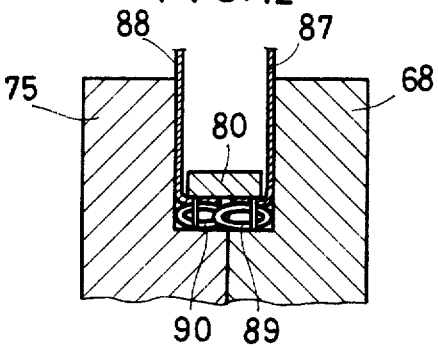
FIG. 12 is a view similar to FIG. 11, showing the position in which the stringers have advanced slightly.

The apparatus 10 will operate follows: The slide fastener stringers 18,19, comprising stringer tapes 87,88 with the rows of coupling elements 89,90 on sides of the tapes facing away from each other (FIG. 7) and directed in the same direction i.e., downwardly, are longitudinally advanced by the grippers 90,91 in the directions of the arrows 94,95 (FIG. 3) until the gripper 91 hits the sixth limit switch 92, whereupon the grippers 90,91 stop moving and the first fluid-pressure actuator 32 is actuated to extend the piston rod 33 and thereby move the end block to the right as viewed in FIG. 1. Slightly after the limit switch 42 has been energized by the end block 20, the actuator 32 is de-activated and simultaneously the holder 23 is raised to the point where the slide fastener stringers 18,19 are juxtaposed by and positioned between the projections 68,75. Then, the second fluid-pressure actuator 50 is actuated to extend the piston rod 51 to move the joint bars 45,46 in the directions 82,83, respectively, enabling the projections 68,75 to displace the stringers 18,19 sideways off the paths 16,17 toward each other as shown in FIG. 7, until the coupler members 64,65 are combined together to thereby gather and slightly outwardly twist the stringers 18,19 as shown in FIG. 8. At the same time that the coupler members 64,65 are put together, the joint bar 45 energizes the limit switch 52, which de-activates the second actuator 50 and actuates the third actuator 60 to extend the piston rod 59, thereby lowering the lever arm 57 down to a position in which the presser 78 is positioned between the stringers 18,19 as shown in FIG. 9 and cooperates with the coupler members 64,65 to constitute the coupler 85. With the parts in this condition, the coupling elements 89, 90 lie under the presser plate 79 in the Y-shaped channel 86 composed of grooves **70*a*, 70*b* and 77. As seen in FIGS. 10 and 11, the tapes 87, 88 are bent by the cooperation of the coupler elements 64, 65 and the presser plate 79 so that the coupling elements 89, 90 lie in conforming relation to one another in groove 77. The presser plate 79 is then caused to press the rows of coupling elements 89,90 against the bottom of the Y-shaped coupling channel 86 to cause portions of the coupling elements 89, 90 in the groove 77 to become interengaged as illustrated in FIG. 12**. In response to energization of the fourth limit switch 62 by the arm 57, the third actuator 60 is rendered inoperative and simultaneously the grippers 90,91 are advanced again past the fifth limit switch 92. As the stringers 18,19 are pulled forcibly through the coupler 85, the rows of coupling elements 89,90 become interengaged as they go through the groove 77 as shown in FIG. 12. When the gripper 91 hits the sixth limit switch 93, the grippers 90,91 are stopped, and the third, second and first actuators 60,50,32 are actuated in the order named to retract their piston rods 59,51,33, thereby disassembling the coupler members 64,65 and the presser 78 apart into the position as shown in FIG. 6. At this time, the rows of coupling elements 89,90 are interengaged over a short interval, as shown in FIG. 16, which corresponds to the interval between the fifth and sixth limit switches 92,93. When the end block 20 engages the first limit switch 41, the grippers 90,91 advance again to draw the stringers 18,19 and are stopped by a limit switch (not shown). The stringers 18,19 are now severed into a finished slide fastener as illustrated in FIG. 16. Then, the grippers 90,91 are retracted past the limit switches 93,92 until they are stopped by another limit switch (not shown), whereupon they grip the ends of the continuous stringers 18,19 for a next cycle of operation.

The apparatus 10 according to the present invention is particularly useful in an application where originally interengaged rows of coupling elements occurring especially at the time of dying or heat-setting should be retained or should not be completely separated to avoid mismating between finished slide fastener stringers and hence malfunctioning of slide fasteners. For example, the finished slide fastener as shown in FIG. 16 has its rows of fastener elements 89,90 interengaged partly at a substantially central portion thereof, the rows of coupling elements 89,90 having been companions throughout various steps of manufacture and been subjected to the same degree of dimensional and property stabilization, so that the stringers 18,19 will not be separated and will go together during storage and shipment for possible maximum performance of the slide fastener.

Figure 13:
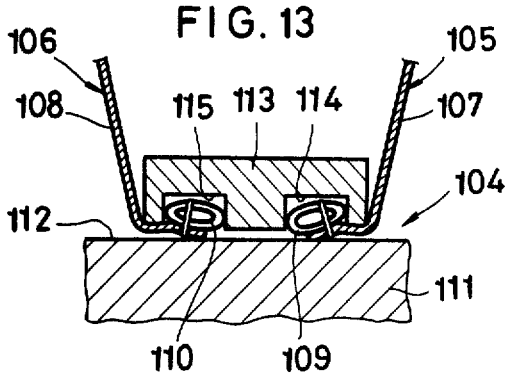
FIGS. 13 through 15 are cross-sectional views of a modified coupler, the views corresponding to FIGS. 10 through 12, respectively.
Figure 14:
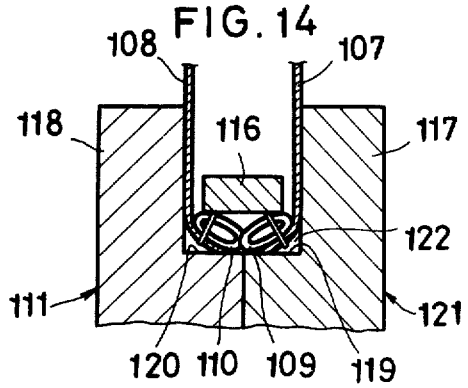
Figure 15:
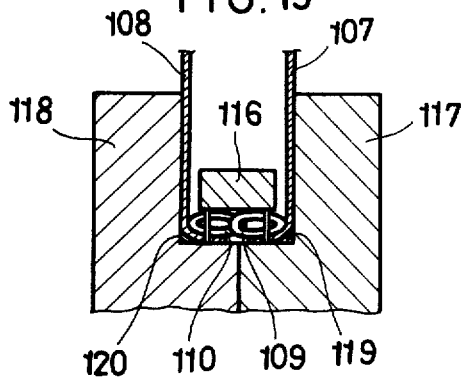

FIGS. 13 through 15 illustrate a modified coupler 104 for intermeshing a pair of slide fastener stringers 105,106 fed longitudinally with a pair of stringer tapes 107,108 supporting a pair of respective rows of coupling elements 109,110 which face toward each other. The coupler 104 includes a coupler member 111 having a flat surface 112, and a presser plate 113 having a pair of spaced grooves 114,115 opening toward the flat surface 112 and receptive of the rows of coupling elements 109,110, respectively. Another coupling member 121 includes a projection 117 which cooperates with a similar projection 118 of the coupler member 111 in defining a groove 122 therebetween which communicates with the grooves 114,115, the groove 122 being composed of a pair of notches 119,120 in the coupler members 121,111, respectively. The presser plate 113 also includes a nose 116, which when the presser plate 113 and the coupler members 121,111 are combined together, is located in the groove 122 to press the rows of coupling elements 109,110 into confronting relation to each other. The rows of coupling elements 109,110 can be interengaged by advancing movement of the stringers 107,108 as illustrated in FIG. 15.

Although certain preferred embodiments have been shown and described in detail, it should be understood that many changes and modifications may be made without departing from the scope of the appended claims.

What is claimed is:

1. A method of interengaging a pair of slide fastener stringers including a pair of rows of coupling elements, respectively, comprising the steps of:
   (a) intermittently feeding the slide fastener stringers respectively along a pair of longitudinal paths in parallel planes with the rows of coupling elements being directed in one direction;
   (b) displacing the stringers sideways off said paths toward each other into a generally Y-shaped coupling channel while the stringers are at rest; and
   (c) turning the rows of coupling elements into confronting relation to each other in said coupling channel, whereby the rows of coupling element can be interengaged when they move through said coupling channel.

2. A method according to claim 1, said Y-shaped coupling channel being formed simultaneously with the displacement of the stringers toward each other.

3. A method according to claim 1, said turning step being effected by pressing the rows of coupling elements against a bottom of said coupling channel.

4. A method according to claim 1, the slide fastener stringers being movable longitudinally for a limited interval while the rows of coupling elements are disposed in said Y-shaped coupling channel, so that the rows of coupling elements can be interengaged over a partial longitudinal interval.

5. An apparatus for interengaging a pair of slide fastener stringers including a pair of rows of coupling elements, respectively, comprising:
   (a) a pair of parallel joint bars movable in opposite directions across a pair of parallel paths of intermittent movement of the slide fastener stringers;
   (b) a pair of separate coupler members on said joint bars, combinable with each other in response to movement of said joint bars;
   (c) a presser movable toward and away from said coupler members as they are combined and separated, respectively, said coupler members and presser jointly defining a generally Y-shaped coupling channel when they are brought together; and
   (d) said coupler members including means for shifting the slide fastener stringers sideways off said paths toward each other into said Y-shaped coupling channel as it is defined by said coupler members and presser.

6. An apparatus according to claim 5, including a table, a fluid-pressure actuator mounted on said table and operatively connected with one of said joint bars, said joint bars having a pair of racks, respectively, and a pinion rotatably mounted on said table and meshing with said racks, whereby said joint bars are movable in opposite directions by actuation of said fluid-pressure actuator.

7. An apparatus according to claim 6, including a lever pivotally mounted on said table and supporting said presser, and a second fluid-pressure actuator pivotally connected to said table and said lever and actuatable in response to said coupler members being combined together for moving said presser toward said coupler members.

8. An apparatus for interengaging a pair of slide fastener stringers including a pair of rows of coupling elements, respectively, comprising:

(a) means for intermittently feeding the slide fastener stringers respectively along a pair of longitudinal paths in parallel planes with the rows of coupling elements being directed in one direction;

(b) means for displacing the stringers sideways off said paths toward each other into a generally Y-shaped coupling channel while the stringers are at rest; and (c) means for turning the rows of coupling elements into confronting relation to each other in said coupling channel, whereby the rows of coupling elements can be interengaged when they move through said coupling channel.

9. An apparatus according to claim 8, said displacing means comprising a pair of parallel joint bars movable in opposite directions across said paths, a pair of separate coupler members on said joint bars, combinable with each other in response to movement of said joint bars, and a pair of projections on said coupler members, respectively, for engaging the slide fastener stringers.

10. An apparatus according to claim 9, said turning means comprising a presser movable toward and away from said coupler members as they are combined and separated, respectively.

* * * * *